United States Patent [19]

Desai

[11] Patent Number: 4,742,929

[45] Date of Patent: May 10, 1988

[54] THREADED CONTAINER CLOSURE

[75] Inventor: Kirit C. Desai, Perrysburg, Ohio

[73] Assignee: Owens-Illinois Closure Inc., Toledo, Ohio

[21] Appl. No.: 838,075

[22] Filed: Mar. 10, 1986

[51] Int. Cl.[4] ..... B65D 41/04

[52] U.S. Cl. ..... 215/332

[58] Field of Search ..... 215/329, 332

[56] References Cited

U.S. PATENT DOCUMENTS 1,556,020 10/1925 Noll ..... 215/332

FOREIGN PATENT DOCUMENTS 313584 7/1919 Fed. Rep. of Germany ..... 215/332

22620 of 1913 United Kingdom ..... 215/329

*Primary Examiner*—Donald F. Norton

[57] ABSTRACT

A closure system featuring a closure having a top wall, a plurality of pillars spaced around the periphery of and depending downwardly from the top wall, and means connecting the lower ends of the pillars. Thread means are formed on the interior surface of at least some of the pillars, and extend inwardly to cooperate with thread means on the neck of a container to bring and maintain the top wall into a sealing relationship with the neck.

4 Claims, 1 Drawing Sheet

THREADED CONTAINER CLOSURE

BACKGROUND OF THE INVENTION

1. Field of the Invention

This invention relates generally to closure systems and, more particularly, to a screw type closure which is useful in any closure application, but is particularly useful as a closure for wide mouth containers.

2. Description of the Prior Act

Screw caps or closures fall into two general categories. In the first class the caps have a continuous internal thread which cooperates with a corresponding external thread formed on the external surface of a neck portion or finish of a container. In the second class, caps have a plurality of spaced lugs or have interrupted threads, formed on the internal surface thereof, which cooperate with corresponding cams or interrupted thread segments formed on the external surface of the neck portion or finish of the container. The first class is by far the most common. Examples of the second class are found in U.S. Pat. Nos. 1,612,449 and 4,202,462.

In addition to the two general classes discussed above there are hybrids which use spaced interrupted threads on a closure in combination with continuous threads on a neck portion of a container, or vice versa. U.S. Pat. No. 1,783,314 discloses a closure with interrupted threads for use with a container having continuous threads on the neck portion.

Lug caps, when used with containers with corresponding cam segments, are usually easier to apply and remove than continuous thread caps. One or more complete turns may be required to remove the continuous thread cap from a container, while a fraction of a turn will apply and remove most lug caps. Many lug caps are formed from metal, but metal has problems with corrosion and paint or laquer scratching on the surface. Moreover, such metal caps tend to be more expensive.

A typical unscrewing closure which is molded from synthetic plastic material consists of three main parts—a top wall, a skirt or side wall depending from the top wall and continuous threads formed on the interior wall of the skirt. The top wall, in combination with any desired additional sealing means such as a liner or gasket provides the necessary seal to protect the product in the container from the ambient environment. The threads provide the capability of applying force to hold the closure in its sealing position on the container. The skirt acts as a link between the threads and the top wall.

In designing a mold for manufacturing a conventional unscrewing closure the following factors are important. The number of threads formed on a closure skirt are limited because of the travel required by an unscrewing mechanism associated with the mold to remove a closure from the mold. Cooling in the core of the mold is limited due to the gear size. Unless core venting is provided, wide mouth closures frequently have sunken top walls.

Controlling the above-noted factors reduces the productivity that might be otherwise achieved. A collapsible core has been used as one way of coping with these factors. However, tooling cost, size limitation and the cooling problems still remain.

SUMMARY OF THE INVENTION

An improved closure is disclosed for a container having a neck portion with an opening therein for dispensing the contents, the neck portion having thread means formed on the external surface thereof. This closure includes a top wall, a plurality of pillars spaced around the periphery of and depending downwardly from the top wall, and means connecting the lower ends of the pillars. Thread means are formed on the interior surface of at least some of the pillars, and extend inwardly to cooperate with thread means on a neck portion to bring and maintain the top wall into a sealing relationship with the neck portion.

The space between each of the pillars having thread means formed thereon is preferably greater than the width of the thread means on the pillars, thereby enabling easier removal of such closures from manufacturing molds by a very short unscrewing turn.

The width of the pillars may be varied in order to meet stress requirements for the closure. For example, the pillar width may be tapered from a larger width at the top end adjacent the junction of the pillar with the top wall to a smaller width at the connecting ring at the bottom end.

The thread means on the interior of the skirt may be varied in form according to the desired end use. As a replacement for the current conventional unscrewing closure, the thread means may be interrupted thread segments following a predetermined helix angle enabling use with existing continuous helical threads on the neck portion or finish of a container. Thus a new or unusual thread configuration on containers would not be required.

It is within the purview of this invention to form the thread means as inclined cam segments to cooperate with corresponding segments formed on a neck portion of a container. In addition, the thread means may be substantially horizontal lug segments which would cooperate with inclined or arcuate cam segments formed on a neck portion.

Although the top wall means illustrated in the drawings is shown as a one piece disk, it is to be understood that the discussion is intended to cover other top wall structures. For example, particularly in wide mouth containers, it is sometimes preferred to have a separate disk with sealing means thereon for contact with the finish. However, sealing pressure is applied to the sealing disk by an annular ring overlying the disk, and having a depending skirt with threads formed on the interior surface.

There is also disclosed a method of molding a closure from synthetic plastic materials which includes the steps of forming a top wall, a plurality of pillars spaced around and depending from the top wall, a ring or other structure connecting the pillars at their bottom ends at a location remote from the top wall, and threads means on the interior surface of at least some of the pillars.

The method may further include spacing pillars with thread means formed thereon farther apart than the width of the thread means carried by such pillars, so that only a very short turn is required to unscrew the closure during removal from a mold. Tapering or varying the width of the pillars enables increased stress resistance at possible fracture points.

It is an object of this invention, therefore, to eliminate or substantially reduce the use of a separate unscrewing mechanism in the manufacturing process of a closure. In the first instance, tooling and mold maintenance costs would be reduced. In the latter instance, productivity would be substantially improved by reducing manufacturing time.

It is further object of this invention to provide a unique closure design which enables weight reduction of the closure and raw material savings.

Another object of this invention is to provide a method for molding closures in which virtually unlimited cooling is feasible, permitting an optimum cycle and substantial improvements in productivity.

Other objects, advantages and features of the invention will become apparent when the following description is take in conjunction with the accompanying drawings.

BRIEF DESCRIPTION OF THE DRAWINGS

In the drawings, where like numerals are employed to designated like parts throughout.

DESCRIPTION OF THE PREFERRED EMBODIMENTS

Figure 1:
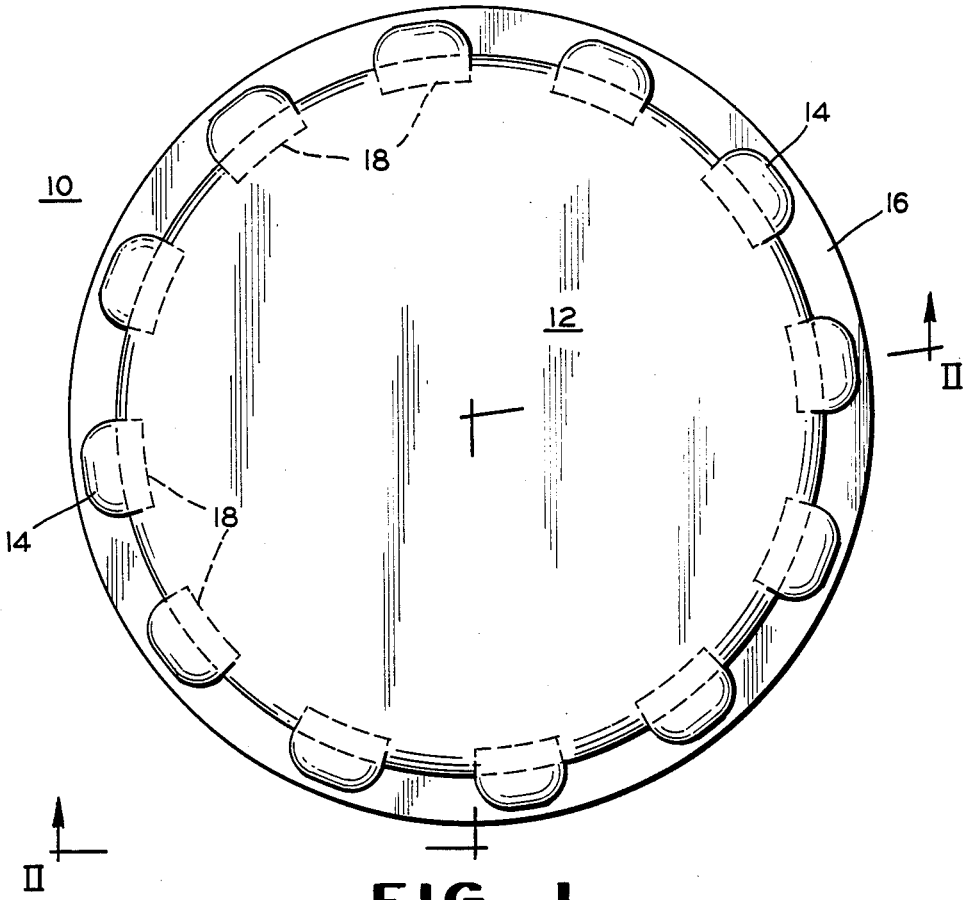
FIG. 1 is a plan view of a closure embodying the teachings of this invention.
Figure 2:
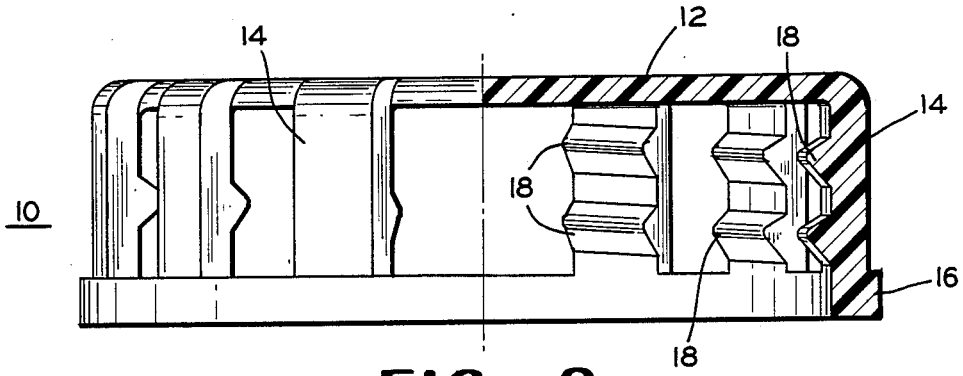
FIG. 2 is a side elevational view with a partial sectional view taken along lines II—II of the closure illustrated in FIG. 1.

Referring now to FIGS. 1 and 2, there is illustrated a closure designated generally at 10 which includes a top wall 12, a plurality of pillars 14 spaced around and depending from the top wall, and an annular ring 16 connecting the lower ends of the pillars remote from the top wall.

Thread means 18 are formed on the interior surface of the pillars 14, while such thread means are shown on each of the pillars in FIG. 1, it is within the scope of this invention to form threads on only some of the pillars.

In the embodiment in FIGS. 1 and 2 the thread means are interrupted thread segments which follow a predetermined helix angle to permit use of the closure with conventional continuous threads on the neck portion of a container. This would enable simple substitution of the new closure in the place of current conventional closures without any modifications required in thread formation on neck portions of existing containers.

Although not shown, it is to be understood that desired additional sealing between the top wall and the neck portion may be provided by liners, gaskets, or other known sealing means.

In this embodiment, as well as those to be discussed hereinafter, it is preferred that the pillars bearing or carrying thread segments be spaced farther apart than the width of the thread segments. This allows the separation of the closure from the mold part carrying the female thread die by turning the mold part or the closure only a short fraction of a turn, and sliding the thread segments vertically through the gap between pillars. In many designs using the teachings of this invention, even a fraction of a turn will not be necessary, since the pillars carrying the thread segments can be easily stripped from the mold.

If an unscrewing motion is required to remove a particular design from the mold, this invention permits closure ejection with less than an inch unscrewing stroke, compared to a 13 to 15 inch unscrewing stroke on a comparable closure with conventional continuous threads. Such a short stroke can be provided by mold opening mechanisms, thereby eliminating hydraulic cylinders, cam rails, and cam followers.

It should be noted that the outside corners of the pillars 14 in FIG. 1 are shown as rounded, while the outside corners of the pillars 14 in FIG. 2 are shown as intersecting planes. Either design may be used, depending upon esthetic, stress resistance, gripping comfort and effect while unscrewing, or other requirements.

Moreover, the shape or form of the pillars may be modified to improve stress resistance or to enable easier removal from a mold. For example, stress analysis of some closures indicates that the majority of the stresses occur at or near the area of contact between the closure and the finish of a container. Therefore, the pillars are preferably tapered from a smaller width at the bottom to a greater width at the top.

The number of pillars and the space between them is governed by the size of the closure and the torque requirements of the particular application.

The interrupted thread segments 18 may also cooperate with spaced interrupted thread segments formed on the neck portion or finish of a container. Such finish thread segments preferably should be separated by a distance greater than the width of the thread segments 18 on the pillars 14. The closure 10 could then be applied to such a finish by guiding the closure thread segments 18 down into the gaps between the neck portion thread segments until the top wall 12 makes initial contact with the top of the neck portion. Then, a fraction of a turn of the closure 10 would complete the sealing relationship of the closure.

A closure of the present invention does not have the limitation on the number of thread segments that presents a practical limit to the continuous thread closure of the prior art. Therefore, more thread segments can be provided on each pillar to coact with a comparable number of thread segments on the neck portion to provide a desired torque resistance against unscrewing and/or to provide a desired sealing force without fracturing the closure or finish. This invention would speed and simplify cap application in a production process because only a fraction of a turn is required, without losing the torque and sealing force advantages of a continuous thread closure.

Figure 3:
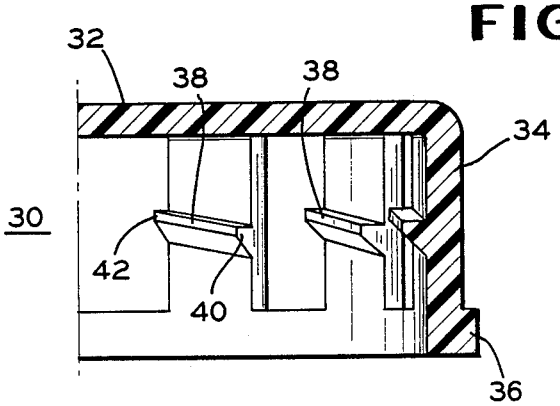
FIG. 3 is a side elevational view, partially in section, of a second embodiment of the teachings of this invention.

Referring now to FIG. 3, there is illustrated a second embodiment of the teachings of this invention. The closure designated generally at 30 comprises a top wall 32, a plurality of pillars 34 depending from the top wall and an annular ring 36 connecting the lower ends of the pillars 34. These elements function in the same manner as the similar elements illustrated in FIGS. 1 and 2.

The thread means 38 in FIG. 3 are formed as inclined cam segments, and do not constitute interrupted threads. That is, the cam segments 38 have their forward edges 40 all at the same lower elevation, while the rear or trailing edges 42 also are all at the same higher elevation. The cam segments 38 are designed to cooperate with separated cam segments on a container finish which have substantially the same degree of inclination to receive the cam segments therebelow and tighten the closure into a sealing relationship with the finish.

Figure 4:
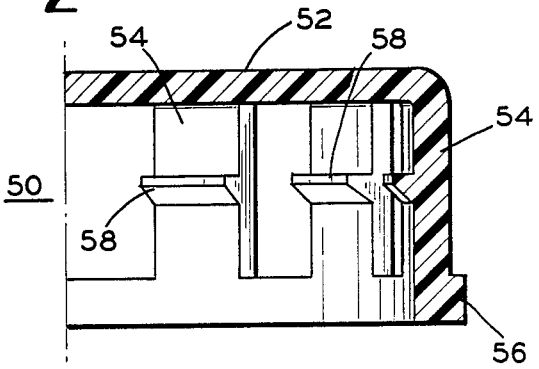
FIG. 4 is partial sectional view of thread means of a third embodiment of the teachings of this invention.

Referring now to FIG. 4 there is illustrated a section of a closure designated generally at 50. The top wall 52, pillars 54 and connecting ring 56 are functionally similar to the similar elements discussed above in previous embodiments.

The thread means 58, however, are formed as inwardly extending lugs that are substantially horizontal.

The lugs 58 may cooperate with spaced and slightly inclined cam elements formed on the neck portion of a container to bring the top wall into a sealing relationship with a neck portion. The lugs 58 may also cooperate with spaced cam elements on a neck portion having arcuate lower surfaces which will urge the lugs downwardly as the lugs engage the arcuate surface.

As in the previous embodiment, the lugs 58 may fit between spaced cam elements on the neck portion, so that the closure may be dropped on the neck portion and tightened to a sealing position with only a fraction of a turn.

There has thus been disclosed a unique closure, and a method for making same, which is less expensive from both a materials and production standpoint.

The form of the invention herein shown and described is to be taken as illustrative only, and changes in the shape, size and arrangement of the parts, or in the steps of the method, may be made without departing from the spirit and scope of the invention.

I claim:

1. A closure for a container having a neck portion with an opening therein for dispensing the contents, the neck portion having thread means formed on the external surface thereof, comprising;

(a) top wall means, (b) a plurality of pillars spaced around the periphery of and depending downwardly from said top wall means, (c) means connecting the lower ends of said pillars, and (d) thread means on the interior surface of at least some of said pillars extending inwardly to cooperate with thread means on a neck portion to bring and maintain said top wall means into a sealing relationship with a neck portion, (e) each of said pillars being tapered from a greater width at the top to a smaller width at the bottom, thereby providing an improved stress resistance at the junction of each of said pillars and said top wall means.

2. A closure as defined in claim 1 in which the space between each of said pillars with thread means thereon is greater than the width of each of the thread means carried by such pillars.

3. A closure as defined in claim 1 in which said means connecting the lower ends of said pillars comprises an annular ring.

4. A closure for a container having a neck portion with an opening therein for dispensing the contents, the neck portion having thread means formed of the external surface thereof, comprising;

(a) top wall means, (b) a plurality of pillars spaced around the periphery of and depending downwardly from said top wall means, (c) means connecting the lower ends of said pillars, and (d) thread means on the interior surface of at least some of said pillars extending inwardly to cooperate with thread means on a neck portion to bring and maintain said top wall means into a sealing relationship with a neck portion, said thread means on said pillars comprising inclined cam segments thereby enabling said closure thread means to cooperate with corresponding segments formed on a neck portion of a container.

* * * * *